US005218721A

United States Patent [19]

Mathews et al.

[11] Patent Number: 5,218,721

[45] Date of Patent: Jun. 15, 1993

[54] AIR INFLATABLE BIB

[76] Inventors: Jeanette Mathews, 821 Lynn St., Chippewa Falls, Wis. 54729; Connie Rose, P.O. Box 113, Vista, Calif. 92084

[21] Appl. No.: 744,892

[22] Filed: Aug. 14, 1991

Related U.S. Application Data

[63] Continuation-in-part of Ser. No. 558,566, Jul. 27, 1990.

[51] Int. Cl.[5] ..... A41B 13/10

[52] U.S. Cl. ..... 2/49 R; 2/49 A; 2/46; 2/48; 2/244; 2/DIG. 3; 446/28; 446/220

[58] Field of Search ..... 2/2, 46, 49 R, 49 A, 2/48, 50, 51, 52, 104, 105, 106, 113, 114, 115, 174, 244, DIG. 3, DIG. 11, 267, 268; 446/26, 27, 28, 220; 441/106, 117, 118

[56] References Cited

U.S. PATENT DOCUMENTS

| | | | |
|---|---|---|---|
| 2,118,196 | 5/1938 | Harrison | 2/DIG. 3 X |
| 2,304,699 | 12/1942 | Levy | 2/268 |
| 2,446,006 | 7/1948 | Hendricks | 2/2 |
| 2,481,544 | 9/1949 | Waggoner | 2/49 A |
| 2,766,445 | 10/1956 | Klaine | 2/49 A |
| 3,046,576 | 7/1962 | Bernhardt | 441/118 X |
| 3,048,395 | 8/1962 | Hobbs | 446/220 X |
| 3,049,736 | 8/1962 | Toulmin, Jr. | 2/2 X |
| 3,076,207 | 2/1963 | Manhart | 441/118 |
| 3,405,414 | 10/1968 | Frieder, Jr. | 441/118 |
| 3,597,763 | 8/1971 | Bienvenu | 2/49 R |
| 4,045,835 | 9/1977 | Flam et al. | 441/106 X |
| 4,226,902 | 10/1980 | Webb | 446/220 X |
| 4,310,927 | 1/1982 | Debose | 2/115 |
| 4,660,226 | 4/1987 | Quilling et al. | 2/49 R |
| 4,737,994 | 4/1988 | Galton | 2/2 |
| 4,834,688 | 5/1989 | Jones | 2/115 |
| 4,977,623 | 12/1990 | De Marco | 2/2 X |
| 5,048,123 | 9/1991 | Monson | 2/DIG. 3 X |
| 5,079,778 | 1/1992 | Sloot | 2/115 X |
| 5,108,339 | 4/1992 | Kieves | 446/220 X |

*Primary Examiner*—Andrew M. Falik
*Assistant Examiner*—Jeanette E. Chapman

[57] ABSTRACT

An air inflatable bib comprising a main body member (10), a catcher member (15) attached to a bottom portion of the main body member (10) and having at least one inflatable air confining chamber joined to the catcher member; wherein at least one inflatable air confining chamber is inflated with air, and extends the adjoined catcher member out and away from a bottom portion of the main body member, whereby forming a wide-open, non-collapsible pouch-like catchall pocket, between a bottom portion of the main body member and the adjoined catcher member; and wherein the bib further includes at least one inflatable air confing chamber/portion (29) joined to the main body member; wherein the air confining chamber/portion is inflated with air to comprise an inflated patterning of the air inflatable bib.

13 Claims, 7 Drawing Sheets

AIR INFLATABLE BIB

CROSS REFERENCE

This patent applicaiton is being submitted as a continuaiton-in-part of our Utility application Ser. No. 07/558,566, filed Jul. 27, 1990.

BACKGROUND OF THE INVENTION

1. Field of Invention

The present invention pertains to the field of protective garments, and more particularly to the field of bibs.

2. Description of Prior Art

Bibs for babies and adults are known. Some bib-like garments have attached catcher members that form a catchall pocket for falling liquids and crumbs, but most are ineffective in that the formed catchall pocket is flexible is nature, and easily folds shut when pressed against a highchair, table, or the body of the wearer during use.

We as inventors have reviewed several types of bibs during our research of related bibs. We have also purchased and used a variety of bib-like garments during the feeding and care of our own children.

For example, most of the precupped, plastic flexible bibs we used did not have sufficient cupping action, in that the catcher member would bend and fold shut due to the flexible nature of the bibs.

The precupped disposable bibs that we tried did not provide a cost efficient multiple use bib, and the attached cups thereon, closed even more readily, again due to the flexible nature of the disposable bibs with catchers. Other bibs having auxiliary, flat catcher trays, require attaching the flat tray to a highchair or other fixed surface for the function and use thereof. The tray-like appendages do not adequately cup the spillage on the tray-like appendage because the tray is not attached to a bottom portion of the base bib to form a pouch-like catchall pocket. The open flat tray provides a surface on which the spills can land, but as such the child can readily play in the spills creating a bigger mess. Also, any measurable spills are not sufficiently contained on a flat tray, even with an "... upstanding inflated wall" on the perimeter, in that the spillage oozes back and off the tray where the inflated wall terminates on a flat surface. Another disadvantage of the bib with an auxiliary tray is that the auxiliary tray has to be attached to a highchair or other fixed surface for use, and then detached from the fixed surface to be cleaned.

The Klaine U.S. Pat. No. 2,766,455 discloses an INFANT'S BIB AND AUXILIARY TRAY, but the difficulty with this invention, is that a child's highchair or other fixed surface is needed to support the auxiliary tray as disclosed. Klaine staes that the combined bib and tray comprise," ... an open frame adapted to rest on a flat support; ... " Claim 1, line 4. Also, on p. 3, line 33, "The tray cover and frame are secured in place on the conventional highchair tray." On p. 4, line 16 Klaine states, "While I have described the structure as a cover and auxiliary tray, it will be understood that in some instances this combination may be used without a main supporting tray, and thus serve as the tray itself." Klaine fails to disclose how the auxiliary tray, just hanging down on the child would provide adequate protection in that the foodstuffs would spill onto the wearer. The "... flaring wall bounding the outer edge of the cover 23 ...," p. 3., line 72, would be ineffective for retaining any measurable foodstuff, without the use of a highchair or fixed support. The Klaine patent fails to adequately disclose how the auxiliary tray would function without an additional support structure.

The Blenvenu U.S. Pat. No. 3,597,763 discloses a RIGID BIB FOR INFANTS. The Blenvenu bib is a rigid bib that is designed to prevent the wearer from lifting his arms and hands too high. The rigid, "C-shaped catchall trough," is not inflatable for use, making this invention difficult to compact and to transport between uses.

The Quilling, et al U.S. Pat. No. 4,660,226 discloses a disposable bib having an absorbent layer in combination with a waterproof layer to form a flexible disposable bib. No attempt is made to utilize a means forming at least one inflatable air confining chamber to retain the catcher member in a more rigid, open position. It would be futile, and difficult to form an inflatable air confining chamber between an absorbent layer and a waterproof layer, in that the relatively porous absorbent layer would release the air.

The Blanchard, British Pat. No. 1,022,886 depicts a rigid bib comprising a rigid, formed feeding bowl on the bottom of the bib. Due to the rigid nature of the bib, it is not designed to be collapsible between uses. Also, no inflatable air confining chamber is incorporated by the bib. The feeding bowl, as designed with the open formed rigid bowl, would create ready access for the child to want to play in the fallen foodstuff, contained therein.

We believe that what is needed is an air inflatable bib having a main body member with a catcher member sealingly attached to a bottom portion of the main body member to form a pouch-like catchall pocket, and further comprises at least one inflatable air confining chamber joined to said catcher member; wherein the at least one inflatable air confining chamber is inflated with air to extend the catcher member to remain in an open position, out and away from the bottom portion of the main body member, whereby forming a wide open, non-collapsible pouch-like catcher pocket, that remains open during use.

The first object of this invention is to form a bib with a main body member having a top portion, with a top edge, a bottom portion with a bottom edge, two side portions with side edges, and having a neck access cutout formed on the main body member, and having a catcher member sealingly attached to a bottom portion of the main body member to form a pouch-like catchall pocket, between the catcher member and a bottom portion of the main body member, and the bib further comprises at least one inflatable air confing chamber attached to the bib.

The second object of this invention is to inflate at least one inflatable air confining chamber of the bib, with air; wherein the catcher member is extended and retained in an open position during use, whereby forming a wide open, non-collapsible catchall pocket, readying the bib for placement and use on the wearer. The air inflatable bib further comprises a suitable valve-like inflatable device joined to a wall of at least one inflatable air confining chamber comprising the bib; wherein the suitable valve-device is opended to inflate at least one inflatable air confining chamber with air. The suitable valve-like inflation device is sealed closed, once sufficient air is contained in the chamber. Furthermore the suitable valve-like inflatable device, functions as a means for releasing air from an inflated chamber when the bib is not in use. At least one inflatable air confining chamber can be inflated with air, during the process of manufacturing the air inflatable bib.

A third object of this bib is to further comprise a means for securing the bib on the wearer so that the bib readily suspends from the wearer's neck without having to use a high chair or other fixed structure for the function and use of the bib. The means for securing the bib on the wearer is chosen from the group comprising: suitable fastening devices, tabs ties, interlocking devices, and combinations thereof.

A final object of this invention is to form at least one inflatable air confining chamber joined to the main body member in the shape of a suitable decorative pattern, to comprise a means of patterning the main body member. At least one inflatable air confining chamber is sealed between two layers flexible sheeting, in the shape of a suitable pattern chosen from the group comprising: animal shapes, toy shapes, alphabet shapes, balloon shapes, suitable decorative patterns, and combinations thereof.

BRIEF DESCRIPTION OF THE DRAWINGS

FIG. 5*a* is a side view of the bib depicted in FIG. 5.

DETAILED DESCRIPTION

Throughout the following description, reference will be made to the drawings. Identical numerals with be throughout the several views to indicate the same or like parts of the invention. The structure and use of the invention will be discussed.

Figure 1A:
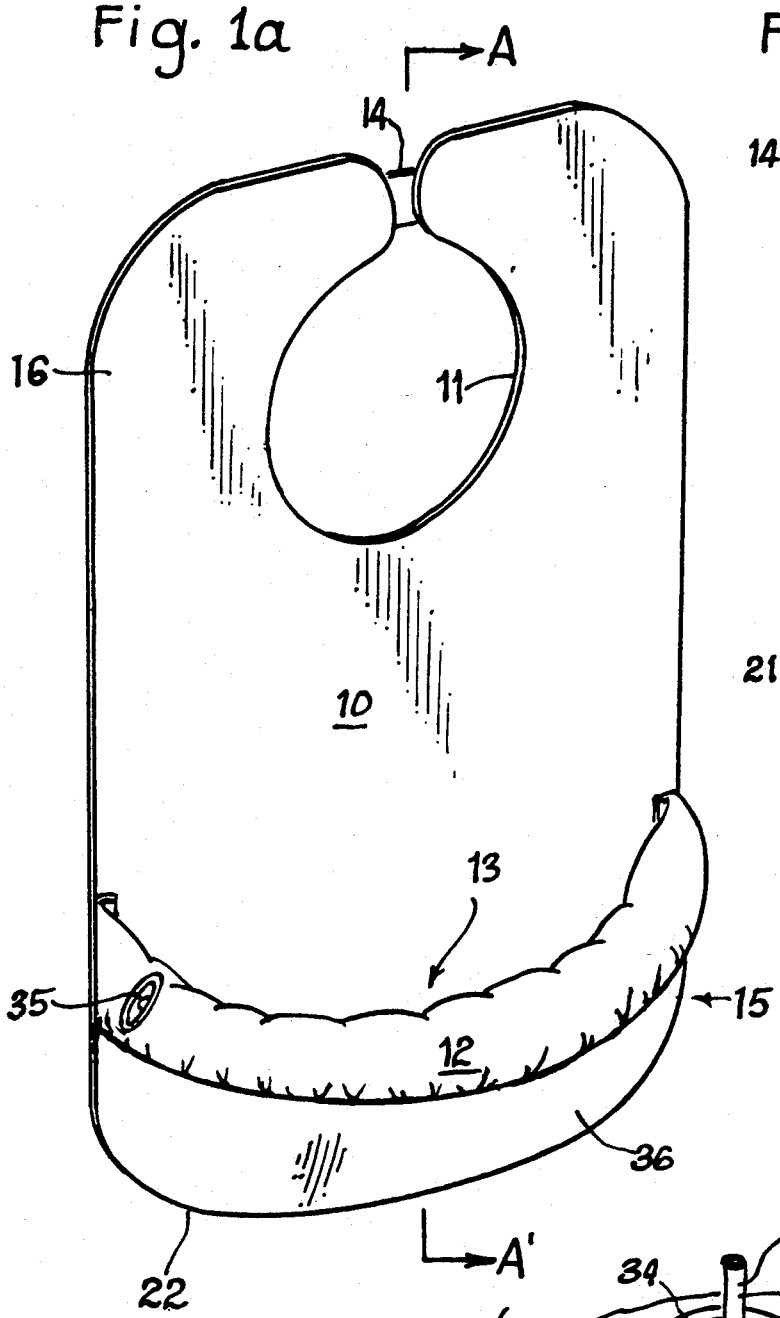
FIG. 1*a* is a view in perspective of an air inflatable bib an inflatable air confining chamber comprising the to rim portion of the catcher member.

Referring now to FIG. 1*a*, the preferred embodiment of the present invention is show, depicting an air inflatable bib comprising a main body member (10) having a catcher member (15) integrally joined to a bottom portion of the main body member (10). The catcher member (15) includes a lower portion (13) and an inflatable top rim of the catcher member; wherein the lower portion lies between the bottom portion of the main body member (10), and the inflatable top rim or chamber (12). The inflatable air confining chamber (12) comprises a suitable valve-like inflation device (35) including a valve (33) which is used to inflate the inflatable air confining chamber (12). The inflatable air confining chamber (12) enables the catcher member (15) to extend out and away from a front facing of a first layer (16) of the main body member (10) to comprise a wide open, non-collapsible catchall pocket that will remain open during use.

Figure 1B:
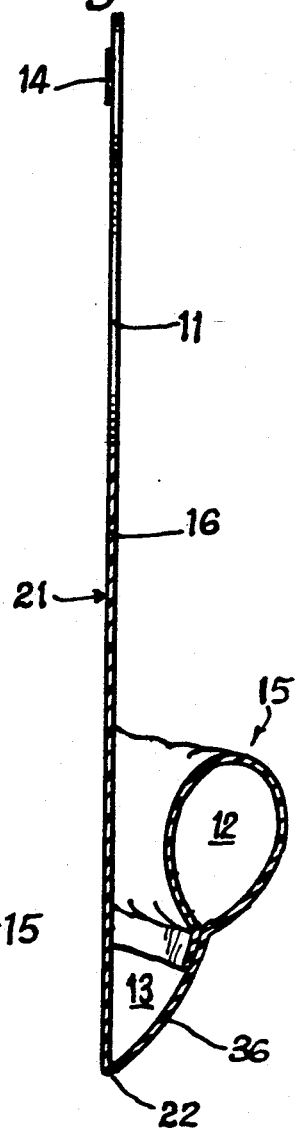
FIG. 1*b* is a side view of the bib depicted in FIG. 1*a*.

FIG. 1*b* is a side view of the air inflatable bib of FIG. 1*a*, depicting an inflataed air confining chamber (12) forming a top rim portion of the catcher member (15), and shows a wide open, non-collapsible catchall pocket forming a lower portion (13) of the catcher member (15); wherein the lower portion (13) of the catcher member (15) is formed between the bottom portion of the main body member (10) and a bottom portion of the adjoined catcher member (15)!

Figure 1C:
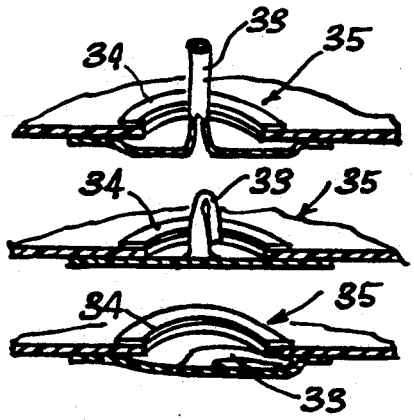
FIG. 1*c* is an enlarged view depicting a suitable valve-like inflation device joined to a wall of the inflatable air confining chamber.

FIG. 1*c* is a view of the bib of FIG. 1*a*, including a suitable valve-like device (35) joined to a wall of the inflatable air confining chamber (12), comprising a retractable stem-like device (33) in combination with a seal (34). The hollow center of the stem-like device (33) is sealed closed by folding and sealing the stem (33) within the seal (34). The suitable valve-like device (35) enables one to release air from the inflatable air confining chamber (12) to deflate the chamber when the bib is not in use, and to facilitate packaging and handling the bib between us handling of the air inflatable bib, when the bib is not in use.

Figure 2:
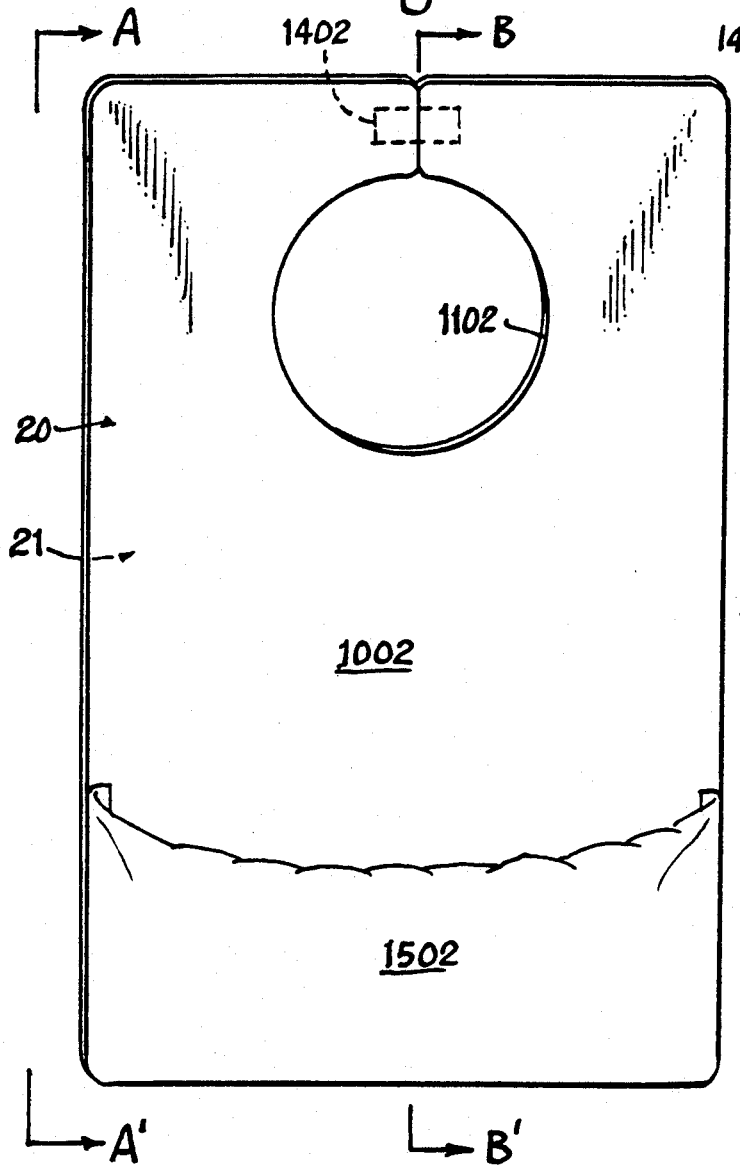
FIG. 2 is a view in perspective depicting an alternative embodiment of the bib; wherein an inflatable air confining chamber forms the entire portion of the catcher member.
Figure 2A:
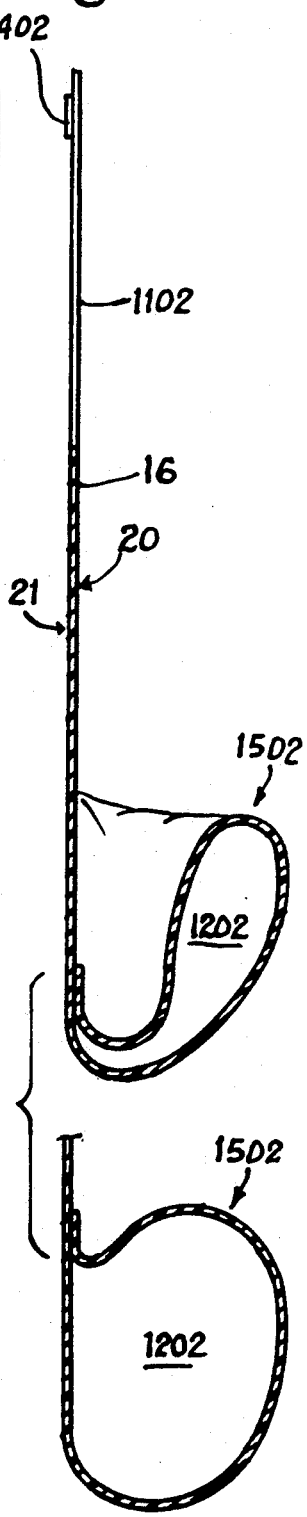
FIG. 2*a* is a side view of the bib depicted in FIG. 2.

FIG. 2 shows an alternative embodiment of the air inflatable bib; wherein the entire catcher member (1502) comprises an inflated air confining chamber (1202). The bib includes a first layer (16) of flexible sheeting of a platic-like material forming a single layered main body member (1002). The first layer offlexible sheeting comprises a front face (20), and a back face (21). FIG. 2*a* depicts a side view of the bib of FIG. 2, comprising a means forming and inflated air confining chamber (1202) forming the entire inflated catcher member (1502), whereby a lower portion of the main body member (1002) is folded over and up upon itself to comprise a space which is sealed to form an inflated air confining chamber (1502) comprising the entire catcher member (1502). The entire inflated catcher member (1502) extend out from a bottom portion of the main body member (1002) whereby forming a wide open, non-collapsible catchall pocket, between the front face (20) of the first layer (16) of the main body member (1002) and the inflated catcher member (1502). Section A—A depicts a side end section view of FIG. 2, and Section B—B depicts a view through the center of the bib of FIG. 2.

Figure 3:
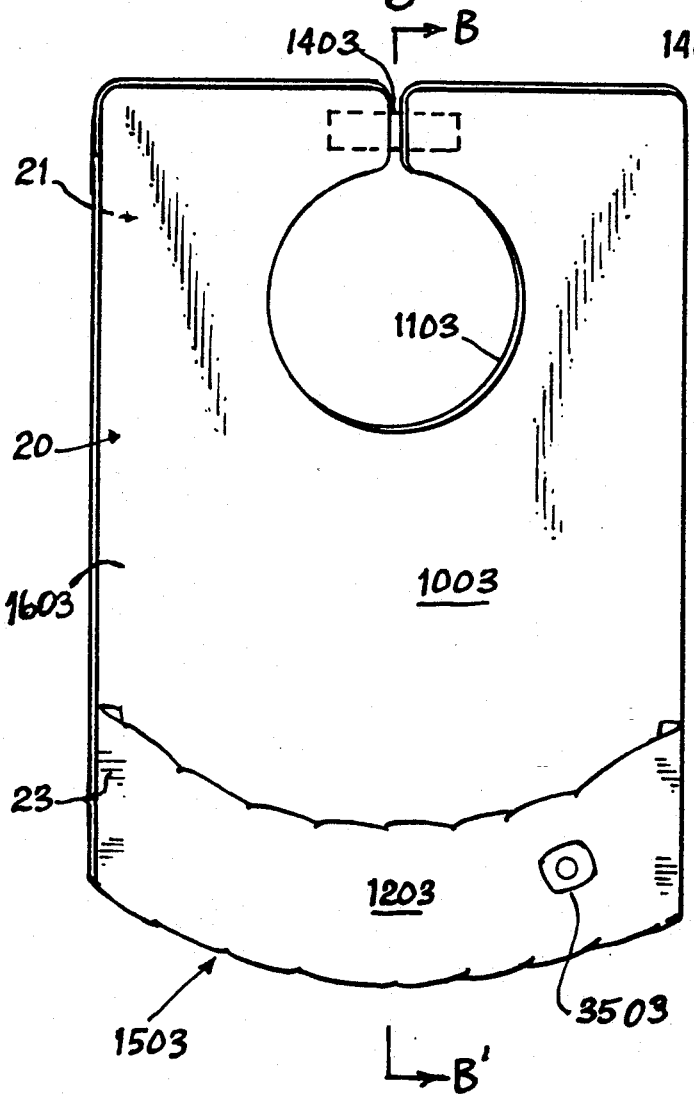
FIG. 3 is a view in perspective depicting an alternative embodiment of the bib; wherein an inflatable air confining chamber comprises a separate inflatable catcher member that is sealingly attached to a bottom portion of the main body member of the bib.
Figure 3A:
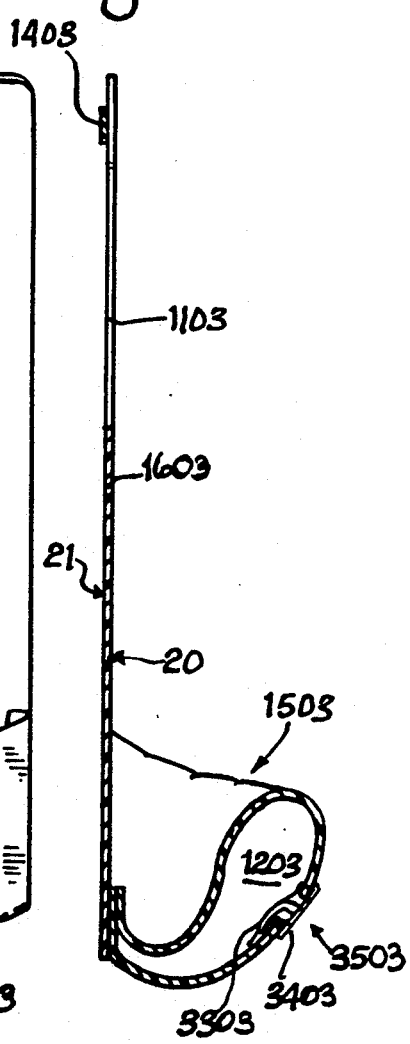
FIG. 3*a* is a side view of the bib depicted in FIG. 3.

FIG. 3 depicts an alternative embodiment of the air inflatable bib having an air confining chamber (1203) comprising a separate inflated catcher member (1503). This member (1503) is attached to the main body member by a sealing means (23). The catcher member (1503) further comprises a suitable valve-like inflation device (3503) joined to a wall of the inflated catcher member (1503). FIG. 3*a* depicts a side view of the bib of FIG. 3 having a wide open pocket formed by the inflated catcher member (1503). The wide open pocket is formed between the inflated catcher member (1503) and the main body member.

Figure 4:
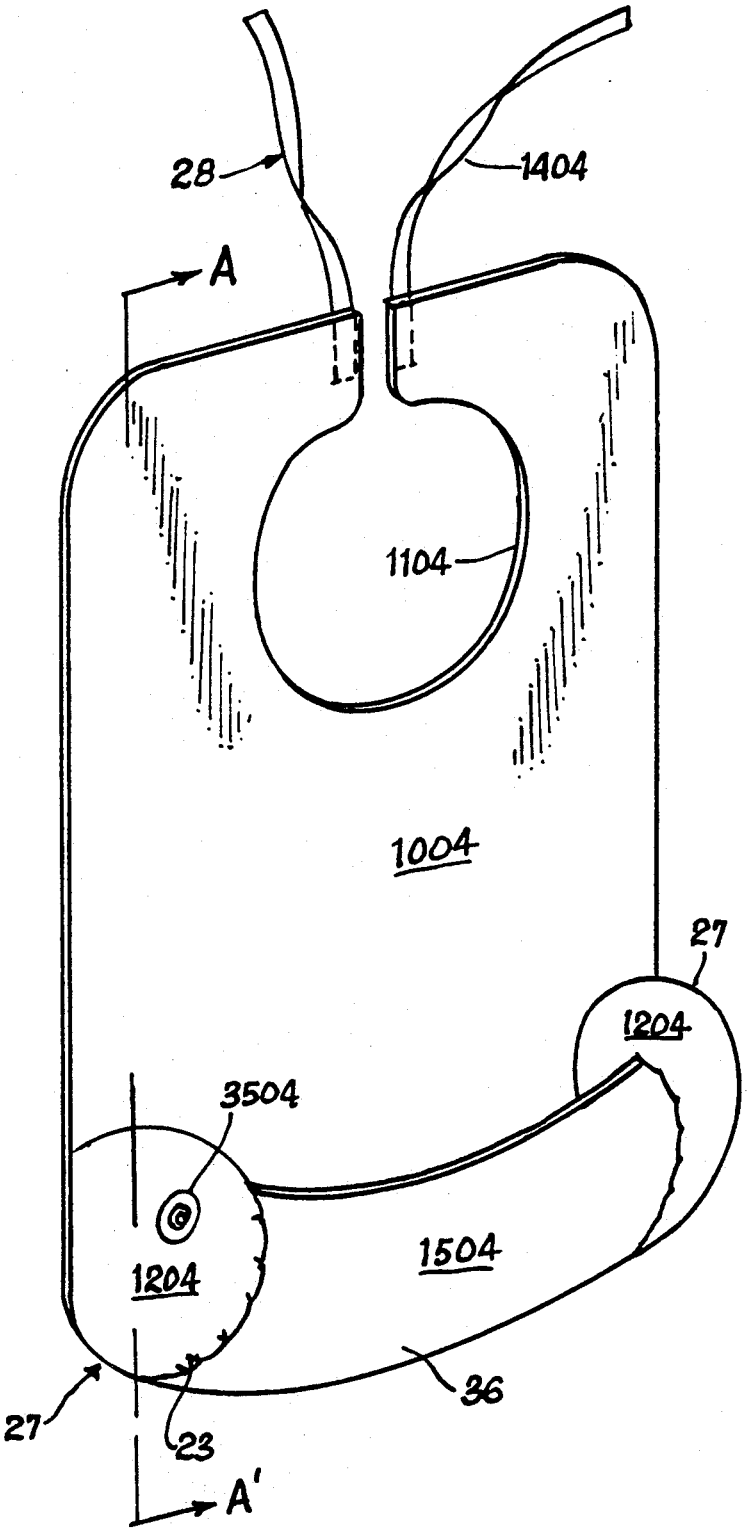
FIG. 4 is a view in perspective depicting an alternative embodiment of the bib having two inflatable air confining chambers comprising two opposite side panels attached to the catcher member; wherein the two opposite side panels are inflatable air confining chambers.
Figure 4A:
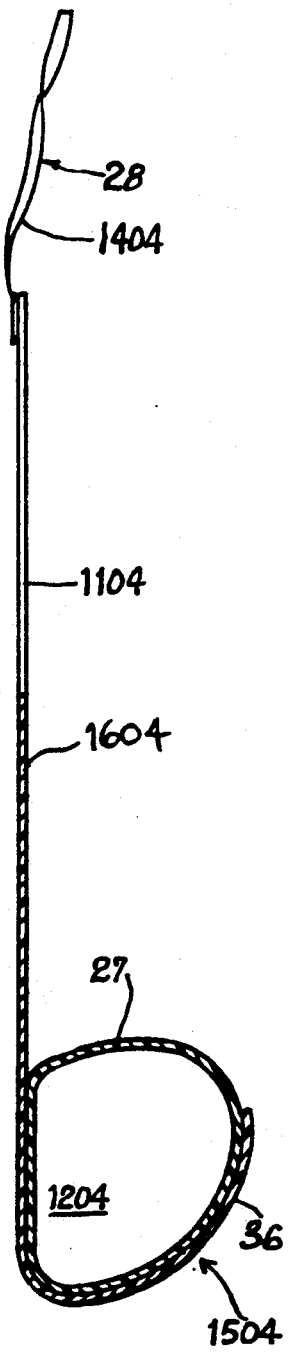
FIG. 4*a* is a side view of the bib depicted in FIG. 4.

FIG. 4 depicts a fourth alternative embodiment of the air inflatable bib having two inflatable air confining chambers (1204). Catcher member (1504) comprises the two inflatable air confining chambers (1204) on opposite sides of the bib (27) and, further includes an uninflated member (36) which lies between, and is joined to the oppositely disposed air confining chambers (1204). Each of said two inflatable air confining chambers (1204) further comprises a suitable valve-like device (3504) formed thereon. Ties (28) comprise a means for securing (1404) the bib on the wearer. FIG. 4*a* A—A! is a side end view of the bib of FIG. 4 having a first layer of plastic-like sheeting comprising the main body member (1004), and the center front member (36) of the catcher member (1504). The two inflated air confining chambers (1204) comprise two opposite end panels (27) joined to the plastic-like sheeting forming the front member (36) of the adjoined catcher member (1504).

Figure 5A:
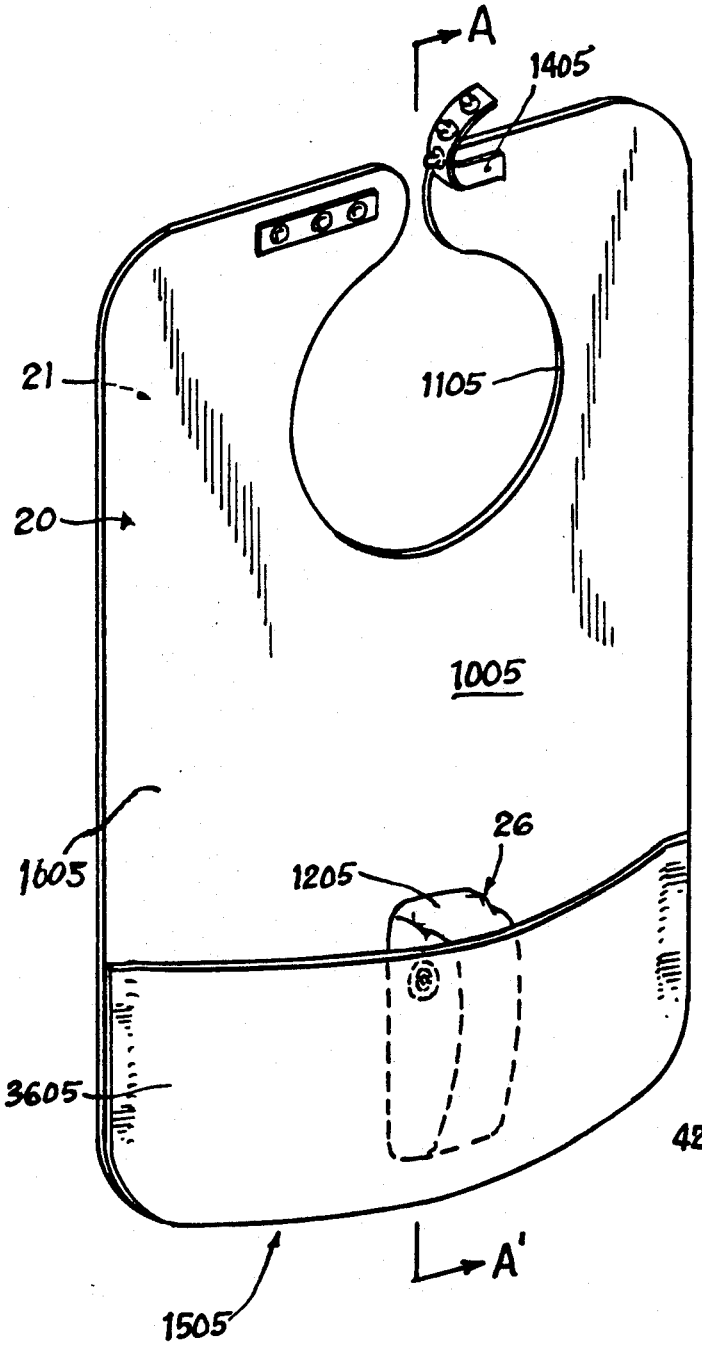
FIG. 5*a* is a view in perspective depicting an alternative embodiment of the bib having an inflatable air confining chamber comprising a divider panel that is inflated between the catcher member and a bottom portion of the main body member.
Figure 5B:
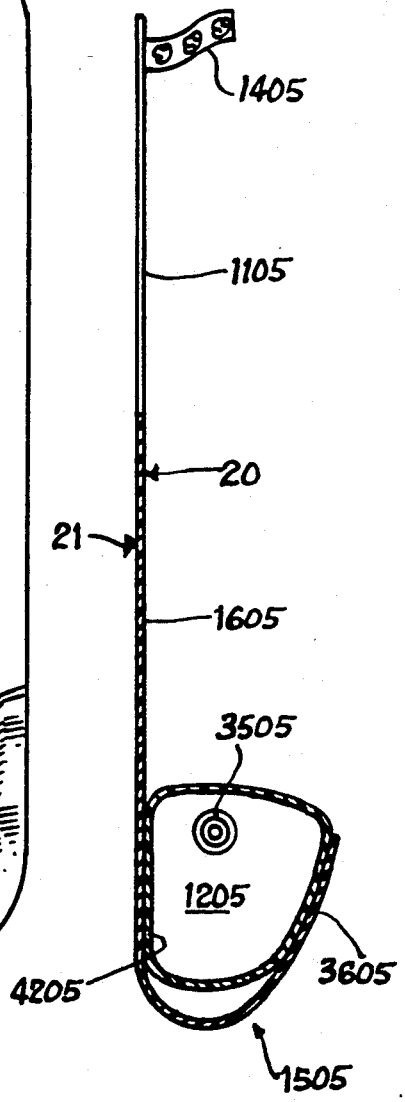

FIG. 5 depicts a fifth embodiment of the air inflatable bib comprising an inflatable air confining chamber (1205) comprising an inflated divider panel (26). The inflatable air confining chamber (1205) is inflated to comprise an inflated divider-like panel (26) disposed between the non-inflated sheeting (3605) of the catcher member (1505), and a portion of the main body member (1005), whereby forming a wide open, non-collapsible catchall pocket, having two compartments. The means for securing the bib on the wearer (1405) comprises a suitable interlocking fastening device (1405) attached to a top portion of the main body member (1005) near the neck access cutout (1105). FIG. 5*a* is a side view of the bib of FIG. 5 at points A—A!, depicting a suitable valve-like inflation device (3505) joined to a wall of the inflatable air confining chamber (1205) forming an inflated divider-like panel (26). The air inflatable bib depicted in FIG. 5*a* includes a sealing means (4205) for attaching the inflatable air confining chamber (1205) forming the inflated divider-like panel (26) to attach between the main body member (1005), and the uninflated front wall member (3605). It is considered within the spirit and scope of this invention to sealingly attach the inflated divider-like panel (26) so as not to extend all the way into the depth of the pouch-like catchall pocket, to create more catching space in the aforementioned pouch-like catchall pocket.

Figure 6:
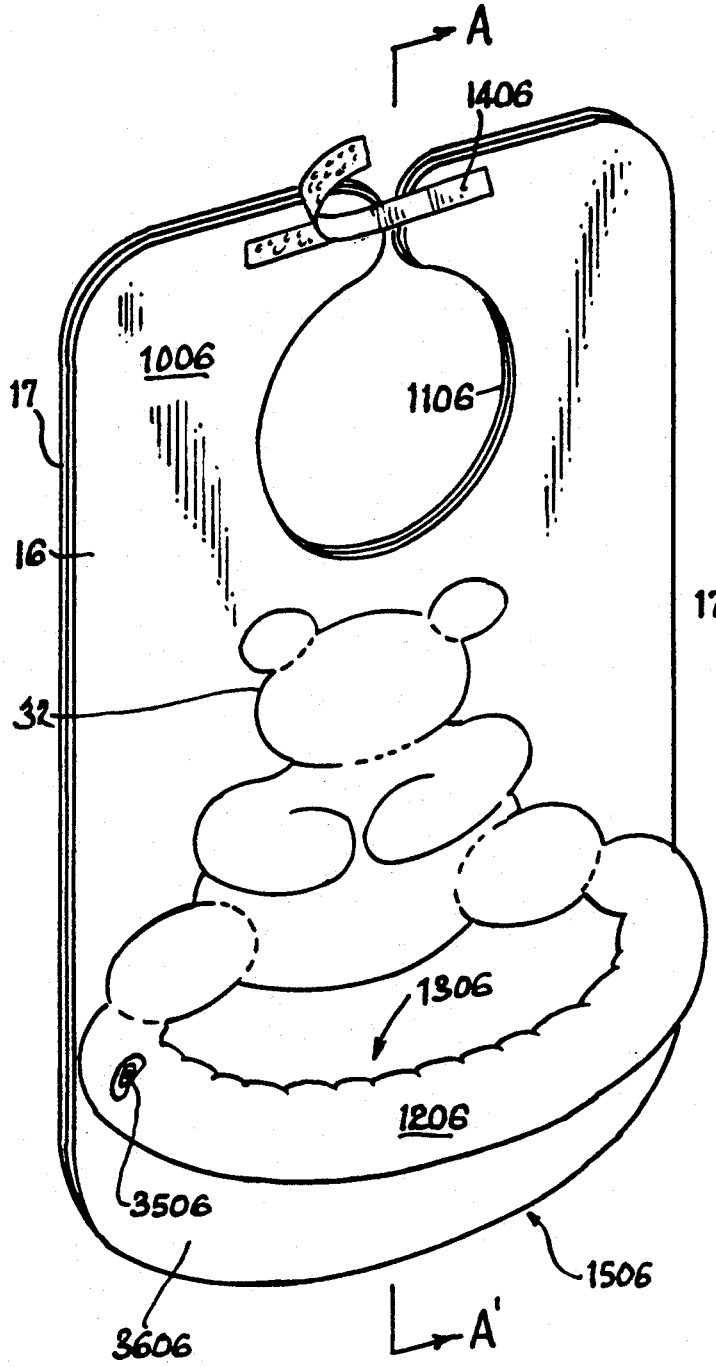
FIG. 6 is a view of the bib depicted in FIG. 1*a*; wherein the bib includes an inflatable air confining chamber comprising a top portion of the catcher member, and an inflatable air confining chamber joined to the main body member having the inflatable air confining chamber joined to the main body member is inflated with air, whereby comprising an inflated patterning of the bib forming a bear-like shape.

FIG. 6 depicts a sixth embodiment of the air inflatable bib. The catcher member (1506) of the bib, includes a lower portion (1306) and an inflated air confining chamber (1206) forming the top rim portion of said catcher member (1506) as disclosed for FIGS 1*a* and 1*b*. This embodiment further includes at least a second inflatable air confining chamber/portion configured in a decorative pattern (3206) such as a bear shape (31) or balloons; a second inflatable air confining chamber (29) is included in the main body member (1006). The main body member of FIG. 6 consist of two layers, a first layer (1606) and a second layer (1706) having a second inflated chamber/portion (29) joined to the front of the main body member (1006). This second inflated portion may be integral with the first inflated portion (1206), or it may comprise a separate inflated chamber/portion (29), which is inflated at the time of manufacture of said bib. The main body member (1006) includes a first layer (1606) joined to a second layer (1706) to comprise two layers forming the main body member (1006). The two aforementioned layers are employed to form the inflated pattern (32) of the main body member; wherein the inflatable chamber of the main body member is contained between the said two layers.

Figure 6A:
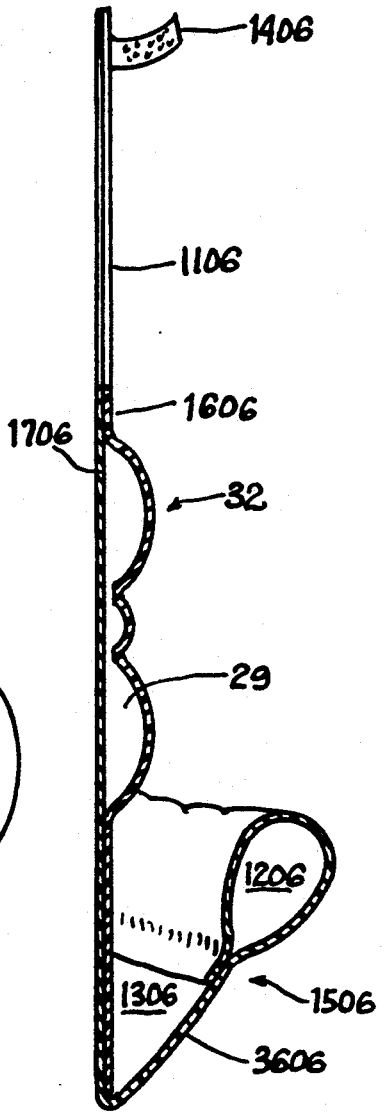
FIG. 6*a* is a side view of the bib depicted in FIG. 6.
Figure 6B:
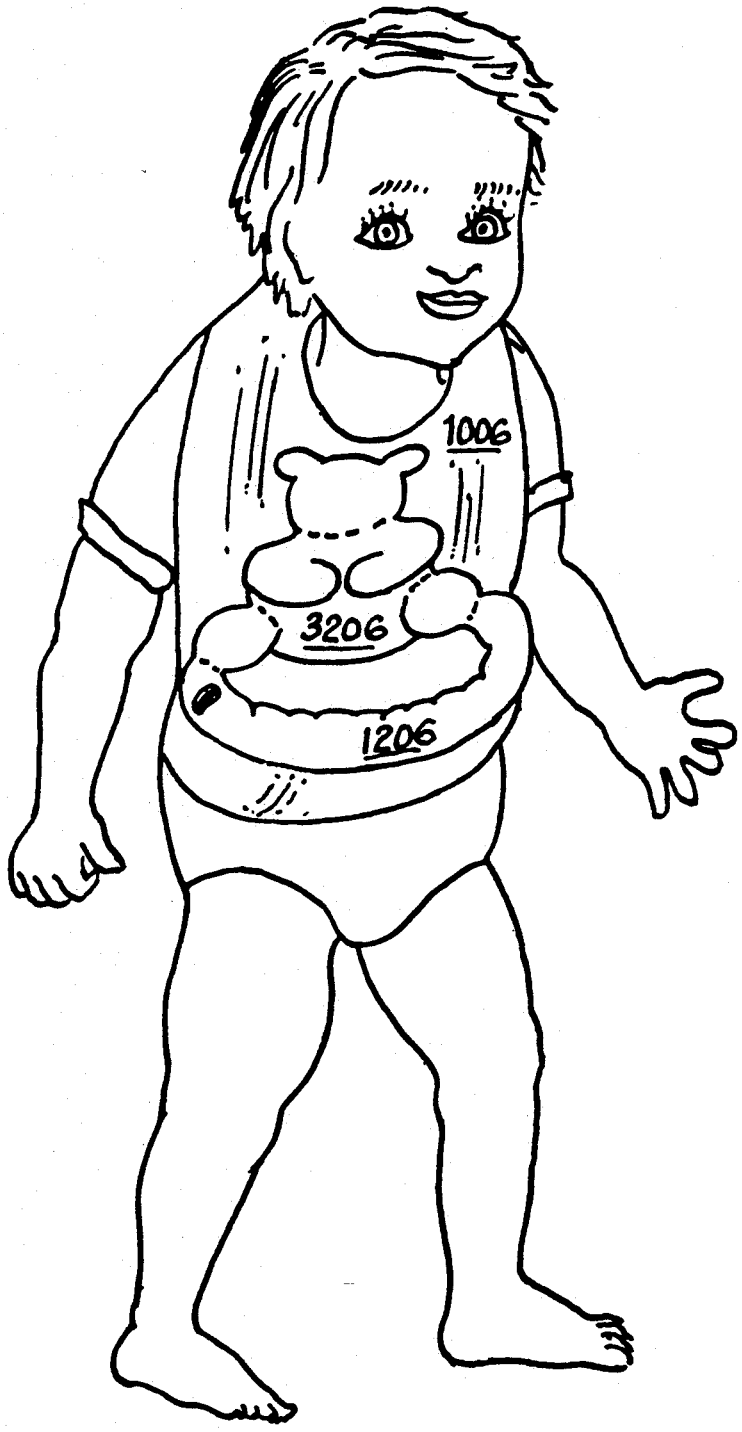
FIG. 6*b* is a view in perspective of the bib of FIG. 6, shown secured around the neck of an infant, without requiring any additional support for the function and use of said bib.

FIG. 6*a* depicts a side view of the bib of FIG. 6 at points A!—A!; wherein this view depicts the wide open, non-collapsible catchall pocket (1306) formed between the inflatable air confining chamber (1206) of the inflated top portion of the catcher member (1506) and a front face (1606) of the main body member (1006). This figure further shows the second inflatable chamber (29) forming a suitable decorative pattern (32) comprising a bear-like shape (31). FIG. 6*b* depicts the air inflatable bib suspended from a wearer's neck, without requiring a high chair or any other fixed support, for use.

FIG. 1 and 1*a* are considered representative of the invention, including the alternative embodiment disclosed herein. Variations of the detail and construction are considered to be within the spirit and scope of our invention.

We therefore belive this invention to be new and useful in that it provides an air inflatable bib having a catcher member and at least one inflatable air confining chamber joined to said catcher member; wherein the inflatable air confining camber is inflated with air to extend the adjoined catcher member to remain open during use, to comprise a wide open non-collapsible catchall pocket on the bib that remains open during use. Our invention further includes, at least one inflatable air confining chamber/portion joined to the main body member in the form of a suitable decorative pattern. The air confining chamber comprising the main body member is inflated with air, and comprises a means forming a raised patterning of the bib conforming to the suitable decorative shape comprised thereby. Finally, the air inflatable bib is secured so that it readily suspends for use, from the wearer's neck without needing additional support such as a high chair or any other fixed structure for the function and use of said bib.

We claim:

1. A bib comprising:

(a) a main body member (10) including a first layer of flexible-sheeting forming a top portion with a top edge, a bottom portion with a bottom edge, two side portions with side edges, and a neck access cutout;

(b) a catcher member (15) joined to a bottom portion of said main body member (10) to form a pouch-like catchall pocket;

(c) at least one inflatable air confining chamber (12) joined to the catcher member (15); and (d) means for securing the bib on the wearer (14), attached to a top portion of the main body member; said at least one inflatable air confining chamber (12) is inflated with air to extend the catcher member (15) in a spaced relationship from the main body member (10) and the catcher (15) form a side open non-collapsible catchall pocket; and the bib is secured on the wearer, by the means for securing, to suspend the bib from the wearer's neck without needing a high chair or other fixed support for the function and use of the bib.

2. A bib according to claim 1 further comprising:

(e) a suitable valve-like inflation device (35), joined to a wall of the at least one inflatable air confining chamber (12).

3. A bib according to claim 1, said means for securing the bib on the wearer, is chosen from the group; consisting of tabs ties and interlocking devices.

4. A bib according to claim 1, the main body member (10) further includes at least a second layer of flexible sheeting, joined to first layer of flexible sheeting to comprise a multilayered bib.

5. A bib according to claim 1, said at least one inflatable air confining chamber includes a second inflatable air confining chamber (29) joined to the main body member (10) in the shape of a suitable decorative pattern, to comprise a means for patterning (32) the main body member.

6. A bib according to claim 5, the suitable decorative pattern comprising the aforementioned means for patterning (32) comprises a suitable decorative pattern chosen from the group consisting of animal shapes, toy shapes, alphabet shapes, balloon shapes, suitable decorative patterns and combinations thereof.

7. A bib according to claim 1, the main body member (10) comprises a first layer of plastic-like flexible sheet (16).

8. A bib according to claim 7, wherein said main body member (10) further includes at least a second layer of plastic-like flexible sheeting, joined to the aforementioned first layer (16) of plastic-like sheeting.

9. A bib comprising:

(a) a main body member (10) including two layers of flexible sheeting and having a top portion with a top edge, a bottom portion with a bottom edge, two side portions with side edges, and a neck access cutout forming a top portion of said main body member;

(b) a catcher member (15) joined to a bottom portion of said main member (10) to form a pouch-like catchall pocket (c) One inflatable air confining chamber (12) joined to the catcher member (15); and (d) means for securing the bib on the wearer attached to a top portion of the main body member;

(e) a means forming a patterning (32) of the main body member (10);

(f) at least one inflatable air confining chamber/portion (29) joined to the main body member (10); and (g) a means for securing the bib on the wearer (14) attached to a top portion of said main body member (10):

said one inflatable air confining chamber (12) is inflated with air to extend the catcher member (15) in a space relationship from the main body member (10) and the bottom portion of the main body member (10) and the catcher (15) form a wide open non-collapsible catchall pocket; and the bib is secured on the wearer by the means for securing in order to suspend the bib from the wearer's neck without needing a high chair or other fixed support for the function and use of the bib;

said second inflatable air confining chamber/portion (29) is joined to the main body member (10) in the shape of a suitable decorative pattern, and said second inflatable air confining chamber/-portion (29) is inflated with air to comprise an inflated means forming a patterning (32) of the bib conforming to the shape of the suitable decorative pattern comprised thereon; and said means for securing the bib on the wearer (14) is secured to suspend the bib for use on the wearer.

10. A bib according to claim 9, said second inflatable air confining chamber (29) is inflated with air during the manufacture of the bib.

11. A bib according to claim 9, said one inflatable air confining chamber (29) of the main body member (10) further includes a suitable valve-like inflation device (35) joined to a wall of the at least one inflatable air confining chamber.

12. A bib according to claim 9, the shape of the suitable decorative pattern comprising said means forming a patterning of the main body member (10) is chosen from the group consisting of animal shapes, toy shapes, alphabet shapes, balloon shapes.

13. A bib according to claim 9 said second inflatable air confining chamber (29) is contained between said two layers of flexible sheeting comprising the main body member (10).

* * * * *